US006186963B1

(12) United States Patent
Schwarze et al.

(10) Patent No.: US 6,186,963 B1
(45) **Date of Patent: *Feb. 13, 2001**

(54) DEVICE FOR GENERATING ACOUSTIC SHOCK WAVES, ESPECIALLY FOR MEDICAL APPLICATIONS

(75) Inventors: Werner Schwarze, Kreuzlingen; Walter Uebelacker, Buergeln, both of (CH)

(73) Assignee: HMT Holding AG (CH)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/071,069

(22) Filed: Apr. 30, 1998

(30) Foreign Application Priority Data

May 2, 1997 (DE) ..... 197 18 513

(51) Int. Cl.[7] ..... A61H 1/00

(52) U.S. Cl. ..... 601/2; 601/4; 367/147; 367/174

(58) Field of Search ..... 601/2–4; 600/439; 367/140, 141, 147, 151, 174, 142

(56) References Cited

U.S. PATENT DOCUMENTS 4,608,983 * 9/1986 Muller et al. ..... 601/4
4,610,249 * 9/1986 Makofski et al. ..... 601/4
4,934,353 * 6/1990 Nowacki et al. ..... 601/4

FOREIGN PATENT DOCUMENTS

WO 91/10228 11/1991 (WO) .

* cited by examiner

*Primary Examiner*—Ruth S. Smith
(74) *Attorney, Agent, or Firm*—Eugene E. Renz, Jr.

(57) ABSTRACT

A device for generating acoustic shock waves, comprising at least two electrodes which form a spark discharge gap G in a fluid volume and a reflector for the acoustic shock waves generated during the spark discharge made of an electrically conductive material, and wherein the power to one of the electrodes is supplied by way of the reflector.

13 Claims, 1 Drawing Sheet

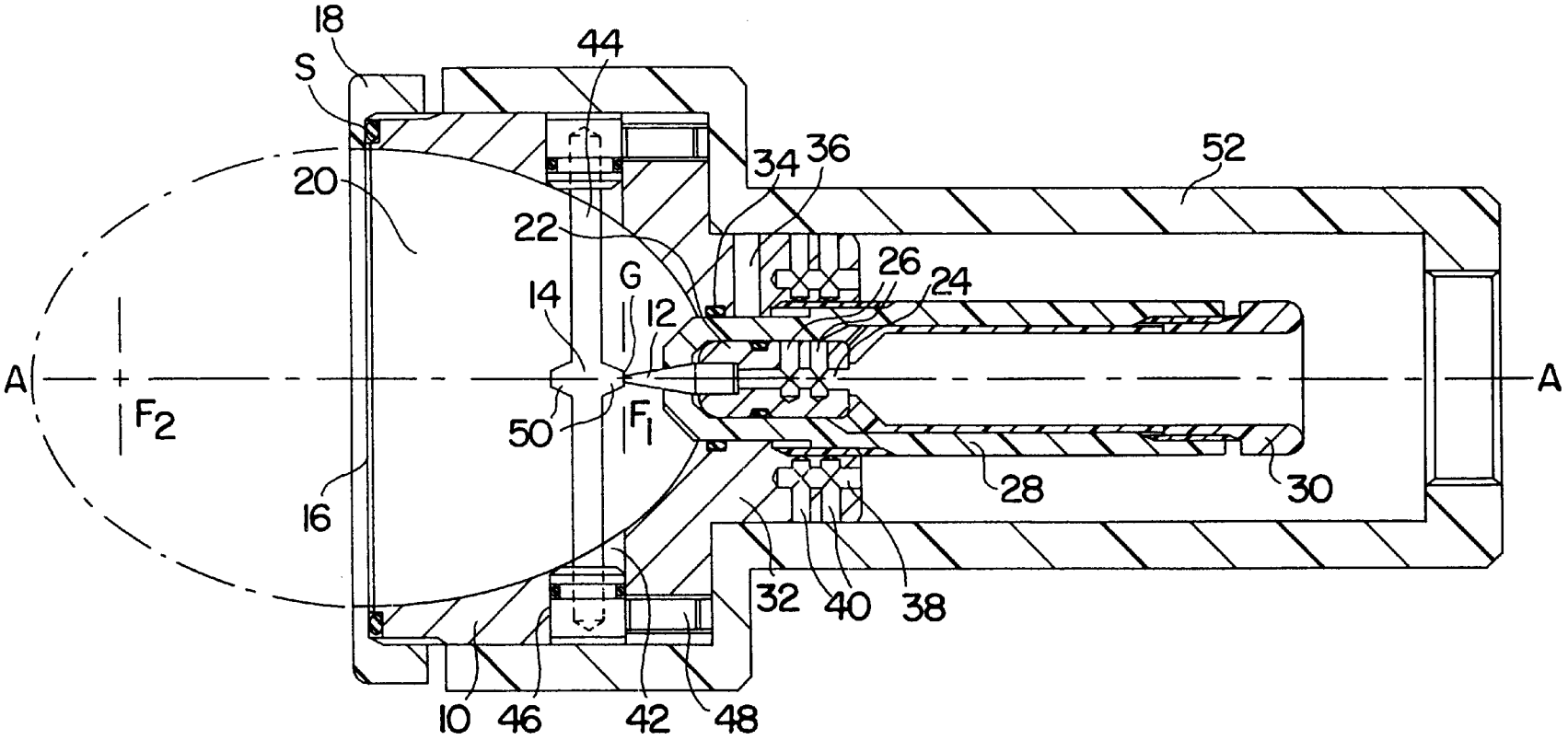
A
52
30
28
24
26
38
36
40
34
32
48
12
G
$F_1$
42
44
22
14
50
46
10
18
S
20
16
$F_2$
A

DEVICE FOR GENERATING ACOUSTIC SHOCK WAVES, ESPECIALLY FOR MEDICAL APPLICATIONS

BACKGROUND OF THE INVENTION

Acoustic shock waves are used to break up concretions in the human body, to treat soft-tissue complaints, to stimulate the nerves, and to treat bone diseases. Devices for generating such acoustic shock waves are known from, for example, EP 0,590,177 A1 and WO 96/09,621. In these devices, an electrical spark discharge is generated between two electrodes in a fluid. The spark discharge causes shock waves to form in the fluid, which are focussed by a reflector on the target area to be treated. To conduct the shock waves generated in the volume of fluid into the tissues of the human body, the fluid volume is closed off by an exciting membrane, which is brought into contact with the surface of the human body. Because the spark discharge is always associated with the loss of material from the electrodes, the electrodes have only a relatively short service life. In the known devices, the electrodes are therefore mounted in the fluid volume enclosed by the exciting membrane in such a way that they can be replaced. The fluid volume is connected to a circulation system, through which the fluid is circulated and where it is processed, that is, heated, filtered, and degassed. The circulation system and the connection of the fluid volume to the circulation system are complicated assemblies and occupy a considerable amount of space. Replacing the electrodes is therefore time consuming and makes it necessary to open up the fluid volume and the circulation system.

SUMMARY OF THE INVENTION

The invention is based on the task of improving a device of the general type described above in such a way that it takes up less space and allows the rapid and easy replacement of the electrodes after they have become worn out.

To this end, the device for generating acoustic shock waves, especially for medical applications comprising at least two electrodes which form a spark discharge gap in a fluid volume and with a reflector for the acoustic shock waves generated during the spark discharge made of an electrically conductive material, and wherein the power to one of the electrodes is supplied by way of the reflector.

The basic idea of the invention is to design the reflector as an electrically conductive component and to use it to supply current to one of the electrodes. As a result, the device becomes much more compact and much simpler in design. The reduction in the size of the shock wave source makes it possible to reduce the size of the entire apparatus and especially of the treatment head, i.e., the part which is placed on the patient to be treated.

In addition, the invention consists in completely enclosing the fluid volume, in which the shock waves are generated, in the reflector and the exciting membrane. Because the fluid volume is therefore no longer connected to a circulation system, the space requirement and the design complexity of the circulation system are eliminated. In particular, it is a simple and convenient process in this design to replace the device after the electrodes have worn out. The reflector with the electrodes and the enclosed fluid volume can be replaced as a single, discreet, compact assembly unit. It is necessary only to disconnect the electrical connections of the electrodes and then to reconnect them again. A simple design by which this can be accomplished consists of a pin-and-socket connection or a screw connection. The replacement of the shock wave source thus becomes as simple as replacing a conventional light bulb.

The enclosed fluid volume also offers the advantage that it is possible to fill the device with a fluid of defined composition. This composition contains physically or electrochemically active substances and consists preferably of water with additives which prolong the service life of the shock wave source. These additives consist of conductive particles, which align themselves with the electrical field of the electrodes and reduce the breakdown field strength. Such particles also make it possible for spark discharges to occur even after the distance between the electrodes has increased as a result of the loss of material from them. When particles of this type are added, there is no longer any need to add salts to increase the conductivity of the water. The corrosive effect of such salts is thus eliminated. In addition, a catalyst such as platinum black which promotes the recombination of the oxyhydrogen gas which forms during the spark discharge is preferably added to the water. In the conventional devices, this oxyhydrogen gas must be removed from the fluid in the external circulation system.

BRIEF DESCRIPTION OF THE DRAWINGS

These and other objects of the present invention and the various features and details of the operation and construction thereof are hereinafter more fully set forth with reference to the accompanying drawing, wherein:

FIG. 1 is a transverse sectional view of an acoustic shock wave generating device in accordance with the present invention.

DETAILED DESCRIPTION OF THE PREFERRED EMBODIMENT

Referring now to the drawing, the device has a reflector 10, the inside surface of which has the form of a body of revolution, e.g., a paraboloid of revolution or a partial section of an ellipsoid of revolution. The spark discharge gap G between a first electrode 12 and a second electrode 14 is situated at one of the focal points $F_1$ of the ellipsoid of revolution located inside reflector 10. The open end of reflector 10 is closed off tightly by an exciting membrane 16. Exciting membrane 16 is held in place by a coupling ring 18, which is screwed with a seal S onto the front end of reflector 10. Reflector 10 and exciting membrane 16 define a slightly enclosed volume 20 which is filled with a fluid, which consists of water, for example, to which conductivity-increasing particles and a catalyst for the recombination of the oxyhydrogen gas have been added. The pressure of the fluid enclosed in volume 20 bulges the exciting membrane elastically outward, out of the flat position shown in the drawing. For this purpose, exciting membrane 16 is preferably designed as a bellows. It is this exciting membrane 16 of the device-with the use a conductive gel-which is placed against the body of the patient to be treated. The pressure exerted by the device on the surface of the body has the effect of elastically deforming membrane 16 to such an extent that the second, outer focal point $F_2$ of the ellipsoid of revolution of reflector 10 coincides with the area of the patient to be treated. The spark discharge generated between first electrode 12 and second electrode 14 creates pressure shock waves in the fluid, which are reflected by reflector 10 and focussed at focal point $F_2$. Exciting membrane 16 allows the high-frequency acoustic shock waves to pass through with virtually no attenuation, whereas low-frequency acoustic waves in the audible range are highly attenuated. These low-frequency waves have practically no medical effect but are an unpleasant accessory effect of the treatment. First electrode 12 is preferably designed as a pin, which tapers to a point. The blunt end of the pin is seated coaxially in an inner conductor 22, which has the form of a cylindrical bushing of brass. From the rear surface, an axial hole 24 leads into inner conductor 22, into which a power supply line is inserted, where it can be clamped tightly in position by screws 26.

First electrode 12 with inner conductor 22 is mounted coaxially in an insulating sleeve 28 and is held in this insulating sleeve 28 by an insulating nut 30, which is screwed into insulating sleeve 28 from the rear. Insulating sleeve 28 and insulating nut 30 consist preferably of plastic, e.g., polyoxymethylene. Reflector 10 is made of a conductive metal, preferably brass. The surface of the ellipsoid of revolution is cut into the front end of a cylindrical block by turning. It is also possible to form reflector 10 out of sheet metal by a shaping process such as pressing. As a result, it is possible to obtain a reflector with a wall thickness of less than or equal to 5 mm, which saves weight and material and facilitates handling. A cylindrical, outer conductor 32 of small diameter is formed on the rear end surface of reflector 10. Insulating sleeve 28 with inner conductor 22 and first electrode 12 are seated in an axial bore in outer conductor 32, so that the tip of first electrode 12 extending from the front end of insulating sleeve 28 projects into reflector 10 and situates itself at first focal point $F_1$ of the reflector. The outside circumference of insulating sleeve 28 is sealed off in the bore of outer conductor 32 by a seal 34. Insulating sleeve 28 is fixed in position in the bore in outer conductor 32 by a locking screw, which is screwed into a transverse hole 36 in outer conductor 32. Holes 38 with parallel axes are introduced into rear end surface of outer conductor 32. Power supply lines are inserted into these holes, where they can be clamped in place by screws 40.

In the axial region of first focal point $F_1$, the cylindrical block of reflector 10 is penetrated by diametrically opposed holes 42. A conductor bar 44 is inserted in these holes 42, so that it extends diametrically across reflector 10. The two ends of conductor bar 44 seated in holes 42 have outside diameters $D_o$ which correspond to the inside diameter $D_i$ of holes 42. At these two ends, conductor bar 44 is sealed off against the walls of holes 42 by seals 46. Screws 48, screwed in from the rear end surface along parallel axes into reflector 10, clamp conductor bar 44 in holes 42 so that it cannot turn or slide and keep it in good electrical contact with reflector 10.

In the axial center of conductor bar 44, which is situated on the central axis A—A of the ellipsoid of revolution of reflector 10, conductor bar 44 has two electrode tips 50, which form second electrode 14. These tips project out from the bar at right angles and are spaced 180° apart from each other. Conductor bar 44 is rotated in holes 42 in such a way that one of the electrode tips 50 points toward the tip of first electrode 12. Between electrode tip 50 of the second electrode and the tip of first electrode 12, a spark discharge gap G is created, which is situated at first focal point $F_1$ of reflector 10. After one of the two electrode tips 50 has become worn down as a result of the loss of material during the course of operation, conductor bar 44 can be rotated 180° around its longitudinal axis in holes 42, so that the unused, second electrode tip 50 can be used to generate the spark discharge. The wear of first electrode 12 can be compensated by pushing insulating sleeve 28 farther up through outer conductor 32.

The power required for the spark discharge is supplied to first electrode 12 by way of inner conductor 22 and to second electrode 14 by way of outer conductor 32, reflector 10, and conductor bar 44. The current-carrying parts of reflector 10 and outer conductor 32 are enclosed and protected by an external housing 52 made of an insulating plastic such as polyoxymethylene. The power cable with the current-carrying wires is guided into housing 52 through the back of housing 52.

The power cable can have a pin-and-socket connector at one end. It is also possible for a pin-and socket connector, which is wired to inner conductor 22 and outer conductor 32, to be installed in the rear of housing 52. In this way, the entire device shown in the drawing can be plugged in or replaced as a single, compact unit. A worn-out device can be refurbished at the factory by replacement of conductor bar 44 and first electrode 12 with new parts. The other parts of the device can continue to be used.

Even though a particular embodiment of the invention has been illustrated and described herein, it is not intended to limit the invention and changes and modifications may be made therein within the scope of the following claims.

What is claimed is:

1. A device for generating acoustic shockwaves comprising at least two electrodes which form a spark gap, an electrically conductive reflector having an axis for focusing the shockwaves, said electrodes and focusing reflector enclosed in a fluid filled chamber sealed by a membrane and said reflector forming part of a circuit for supplying power to one of said electrodes.

2. Device according to claim 1, wherein one of said electrodes is aligned with the axis of the reflector and passes through the reflector but is insulated from it.

3. Device according to claim 2, characterized in that the other electrode comprises an electrode tip which projects out from a conductor bar at a right angle.

4. Device according to claim 1, further including a conductor bar having an axis arranged in the reflector so that the conductor bar can be rotated around its axis and wherein the conductor bar carries at least two projecting electrode tips, which are offset with respect to one another around the axis of the conductor bar.

5. Device according to claim 1, wherein the fluid is enclosed by the reflector and said membrane and wherein said membrane is a flexible expandable member.

6. Device according to claim 1, wherein the fluid enclosed in said fluid filled chamber contains at least one conductivity-improving additive and at least one additive as catalyst which promotes the recombination of oxyhydrogen gas.

7. Device according to claim 1, wherein said at least two electrodes are replaceably installed in a sealed manner in the reflector.

8. A device as claimed in claim 1 wherein said fluid is self contained thereby alleviating the need for a separate fluid circulating system.

9. A device as claimed in claim 1 including a housing having a detachable electric connector, and wherein said focusing reflector, said fluid chamber, and said electrodes are enclosed in said housing.

10. A device as claimed in claim 1 wherein said fluid has electrochemical additives other than salt to prolong said electrodes service life.

11. A device for generating acoustic shockwaves comprising a housing, at least two electrodes which form a spark gap, an electrically conductive reflector for focusing the shockwaves, said electrodes and focusing reflector enclosed in a fluid filled chamber sealed by a membrane, said reflector forming part of a circuit for supplying power to one of said electrodes and wherein said housing enclosing said focusing reflector, fluid filled chamber and electrodes form a single discreet selectively removable unit.

12. A device for generating acoustic shockwaves comprising a housing, at least two electrodes which form a spark gap, an electrically conductive reflector for focusing the shockwaves, said electrodes and focusing reflector enclosed in a fluid filled chamber sealed by a flexible, expandable membrane and said reflector forming part of a circuit for supplying power to one of said electrodes, said housing having a detachable electric connector and enclosing said focusing reflector, said fluid chamber, and said electrodes and forming a single, discreet selectively removable unit and wherein worn out electrodes can be refurbished or replaced with new parts.

13. A device for generating acoustic shockwaves comprising first and second electrodes which form a spark gap, on electrically conductive reflector for focusing the shockwaves, said electrodes and focusing reflector enclosed in a fluid filled chamber sealed by a membrane and said reflector forming part of a circuit for supplying power to one of said electrodes, said first electrode extending diametrically across said reflector and said second electrode extending axially and being coincident with the major axis of the reflector.

* * * * *